US008261788B2

(12) United States Patent
Bragnalo

(10) Patent No.: US 8,261,788 B2
(45) Date of Patent: Sep. 11, 2012

(54) MORTISE AND TENON JOINERY OF LOG MEMBERS

(76) Inventor: Tyler Bragnalo, Kaministiquia (CA)

( * ) Notice: Subject to any disclaimer, the term of this patent is extended or adjusted under 35 U.S.C. 154(b) by 171 days.

(21) Appl. No.: 12/773,435

(22) Filed: May 4, 2010

(65) Prior Publication Data

US 2010/0282368 A1 Nov. 11, 2010

(30) Foreign Application Priority Data

May 5, 2009 (CA) ..... 2664608

(51) Int. Cl.
*B27D 1/00* (2006.01)
*B27F 7/00* (2006.01)

(52) U.S. Cl. ..... 144/344; 144/347; 144/354

(58) Field of Classification Search ..... 144/344, 144/347, 354
See application file for complete search history.

(56) References Cited

U.S. PATENT DOCUMENTS 2,123,081 A * 7/1938 Sadenwater ..... 403/290
2,774,609 A * 12/1956 Winger ..... 280/79.11
2,981,669 A * 4/1961 Brand et al. ..... 29/525
3,490,188 A * 1/1970 Troutner ..... 52/644
* cited by examiner

*Primary Examiner* — Bena Miller
(74) *Attorney, Agent, or Firm* — Ryan W. Dupuis; Kyle R. Satterthwaite; Ade & Company Inc.

(57) ABSTRACT

A method of joining a plurality of elongate log members using mortise and tenon joinery includes the step of forming mortise sockets in the log members at a controllable depth relative to a longitudinal central axis of the log members. Log members having tenons formed thereon for connection between two mortise bearing log members can thus be standardized and interchangeable with one another even when an outer surface of the log members is irregular in profile. A device for forming mortise sockets and tenons on log members in a reproducible manner includes a pair of work holders which define a longitudinal axis of the log member. A mortise cutter and a tenon cutter are supported for movement relative to the work holders for controllably forming the mortise sockets and tenons in a log member relative to the longitudinal central axis of the log member.

18 Claims, 9 Drawing Sheets

MORTISE AND TENON JOINERY OF LOG MEMBERS

This application claims foreign priority benefits from Canadian Patent Application 2,664,608, filed May 5, 2009.

FIELD OF THE INVENTION

The present invention relates to a method of joining elongate log members of irregular shape using mortise and tenon joints, and a mortise and tenon device arranged for forming mortise sockets and tenons on log members in a controllable manner regardless of the irregular shape of the log members.

BACKGROUND

Mortise and tenon joinery can be used for many applications in the log home industry. These applications range from exterior deck railing to interior staircase and loft railing, to dining room and bedroom furniture.

The steadily growing log home industry, in 2003, had over $1.5 billion in sales and has more than 550 manufacturers in North America alone. An estimated $70-$100 million of these sales are composed of small diameter log joinery. The process of creating this joinery however is very labor and layout intensive and requires skilled craftsmen to perform the work. The current method of constructing custom log joinery involves making each component individually.

In the interest of continuity the following discussion is limited to the production of log railing. The concepts discussed can however be extended to the production of furniture as well.

The components of a log railing consist mainly of the following: 1) vertical posts providing the interface between the railing and the deck; 2) horizontal rails which connect the posts; and 3) spindles.

A key aspect in providing a professional looking product is ensuring a tight fit at the interface between any two components. This tight fit involves mating a conical surface and a cylindrical surface and therefore requires the axial dimension of each component to be based on the surface separation of the two elements between which it is to be joined. This surface dimensioning system is fundamentally variable due to the taper and curvature of a natural log.

The existing method of building log railings or furniture uses a surface dimensioning system. This requires a process as follows: 1) Layout and install the posts complete with pre-drilled mortises; 2) Measure the surface-to-surface length of the top and bottom rails—these dimensions will differ due to the taper and other irregularities of the posts; 3) Allow for the tenon length, which extends into the mortise beyond the surface interface, cut the rail material to length and drill the rail tenons; 4) Layout and drill the rail mortises; 5) Install the two rails in the posts, or some other jig which can spread the rails to some predetermined parallel; 6) Measure the surface-to-surface length of each spindle, which will all differ due to the irregularity in the material; 7) Add the tenon length to each of these individual spindle dimensions and cut each spindle to length; 8) Cut the tenons on each spindle; 9) Disassemble rails from posts (or jig) and install the spindles into the rails; 10) Install the whole rail-spindle assembly into the posts; and 11) Re-secure the posts to the sub-framework.

This surface dimensioning system implies that each post, rail and spindle produced, fit in only one individual position in the railing. This custom process proves to be far too inefficient for industrial production. Consider for example a 150 ft railing, around an exterior deck, which could consist of up to 20 Posts, 40 Rails and 400 Spindles. Unless the job is done on site, the accounting nightmare is considerable.

In order to industrialize the process, some companies have turned the logs into perfect cylinders ensuring constant predicable surface dimensions. This has however increased the production costs and eliminated the custom and natural look of the product, thereby decreasing the retail value and subsequently the overall return.

There is therefore a need for a machine which, using naturally occurring irregular material, can produce custom looking railing or furniture in a modular industrial fashion.

SUMMARY OF THE INVENTION

According to one aspect of the invention there is provided a method of joining a plurality of elongate log members using mortise and tenon joinery, the method comprising:

selecting a first log member to comprise a mortise bearing member;

locating a longitudinal axis of the first log member extending centrally through the first log member in a longitudinal direction along a length of the first log member;

selecting a second log member to comprise a tenon bearing member;

locating a longitudinal axis of the second log member extending centrally through the second log member in a longitudinal direction along a length of the second log member;

forming a tenon at one end of the second log member comprising a first mating surface of reduced diameter which is coaxial with the longitudinal axis of the second log member;

measuring a selected distance in an axial direction between the first mating surface and the longitudinal axis of the first log member;

forming a mortise socket in the first log member comprising a second mating surface in which the mortise socket is arranged to matingly receive the tenon therein such that the first and second mating surfaces are abutted with one another;

wherein the mortise socket is formed to have a depth relative to an outer surface of the first log member such that the second mating surface is located at said selected distance from the longitudinal axis of the first log member when the first and second mating surface are abutted with one another.

Preferably the first and second mating surfaces are formed to be generally conical in shape.

The method may further comprise: i) forming the tenon to comprise: a first portion of reduced diameter which is generally cylindrical; and a second portion which is generally conical which increases in diameter from the first portion to a remainder of the log member and which defines the first mating surface; and ii) forming the mortise socket to comprise: a first portion of reduced diameter which is generally cylindrical to matingly receive the first portion of the tenon therein; and a second portion which is generally conical to matingly receive the second portion of the tenon therein and which defines the second mating surface.

By measuring the distance between the mating surfaces of the tenons and the longitudinal axis of the mortise bearing member and controlling the depth of the mortises formed therein relative to an axis of the mortise bearing member instead of the surface thereof, it is possible to standardise the length and configuration of the tenon bearing members such that the members are interchangeable with one another and can be mass produced at lower cost and greater efficiency than the custom fabrication currently required for mortise and tenon joints in log members of irregular profile.

The method may further comprise: selecting a plurality of second log members, each comprising a tenon bearing member having a tenon formed at one end thereof; and forming a mortise socket in the first log member to receive each of the second log members therein such that the mating surface of each mortise socket is located at said selected distance from the longitudinal axis of the first log member.

Preferably the mortise sockets are formed such that an axis of each socket is oriented perpendicularly to the longitudinal axis of the first log member. Alternatively, the mortise sockets may be formed such that an axis of each socket is oriented at an inclination to the longitudinal axis of the first log member.

The method may further comprise: i) supporting a pair of first log members space apart from one another; ii) locating a plurality of mortise sockets in each of the first log members; iii) selecting a plurality of second log members; iv) forming tenons at opposing ends of each second log member such that a length of each second log member between mating surfaces thereof is identical to the other second log members; and v) inserting the tenons into respective ones of the mortise sockets such that each second log member is supported to extend between the pair of first log members.

The pair of first log members may be supported such that the longitudinal axes of the first log members are parallel and spaced apart from one another.

The plurality of mortise sockets may be located in each of the first log members such that the mating surface of the mortise sockets within each first log member are located at a common selected distance from the longitudinal axis of the first log member.

Even when using a plurality of second log members which have an irregular profile which varies in radial dimension from the longitudinal axes thereof along a length of the second log members, the method preferably involves forming the tenons of the second log members such that the second log members are interchangeable with one another and forming tenons on opposing ends of the second log member such that both tenons are coaxial with the longitudinal axis of the second log member.

According to a second aspect of the present invention there is provided a device for forming mortise sockets in a log member having an irregular profile, the device comprising:

a frame;

a pair of work holders supported on the frame at spaced apart positions so as to be arranged to engage opposing ends of the log member, the pair of work holders defining a longitudinal axis of the log member along a central axis extending between the pair of work holders;

a rotatable mortise cutter arranged to form a mortise socket in the log member;

the mortise cutter being rotatably supported on the frame for movement in a radial direction relative to the central axis extending between the pair of work holders; and a controller arranged to displace the mortise cutter at a controllable distance relative to the central axis so as to be arranged to form the mortise socket in the log member at a controllable depth relative to the central axis of the log member.

When the mortise cutter is supported for rotation about a mortise cutter axis, the mortise cutter is preferably supported on the frame by a track for linear movement relative to the work holders along the track which is oriented along the mortise cutter axis in the radial direction relative to the central axis extending between the pair of work holders.

The track is preferably supported on the frame for sliding movement in a direction of the central axis along a full length of the frame between the work holders.

Preferably the track is also supported on the frame for pivotal movement relative to the frame about a lateral axis lying in a plane which is perpendicular to the central axis such that an orientation of the linear movement of the mortise cutter relative to the central axis is adjustable.

According to a further aspect of the present invention there is provided a device for forming a tenon on a log member having an irregular profile, the device comprising:

a frame;

a pair of work holders supported on the frame at spaced apart positions so as to be arranged to engage opposing ends of the log member, the pair of work holders defining a longitudinal axis of the log member along a central axis extending between the pair of work holders;

at least one of the work holders comprising:

a central spindle arranged to engage the respective end of the log member at the central axis of the work holders in fixed relation to the log member;

a tenon cutter surrounding the central spindle including at least one cutting blade for forming a tenon;

the central spindle and the tenon cutter being supported for rotation relative to one another about the central axis of the work holders so as to be arranged for rotation of the tenon cutter relative to the log member; and the tenon cutter being slidable along the central axis relative to the central spindle between a starting position in which the central spindle projects axially towards the opposing work holder beyond the tenon cutter and an ending position in which the tenon cutter projects axially towards the opposing work holder beyond the central spindle so as to surround an end of the log member.

The central spindle and the tenon cutter are preferably supported for rotation relative to one another independently of the relative sliding movement between the starting position and the ending position.

In a preferred embodiment, both of the work holders may comprise a central spindle and a tenon cutter which are substantially identical to one another, one of the central spindles being fixed in a direction of the central axis relative to the frame and the other one of the central spindles being adjustable in the direction of the central axis relative to the frame so as to be arranged to adjust a relative spacing between the work holders.

Some embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Referring to the accompanying figures there is illustrated a method of mortise and tenon joinery of a plurality of log members 10 in which the connecting portions of the log members are formed using a mortise and tenon forming device 12. The method and device are useful with natural log members which are elongate in a longitudinal direction and have an irregular natural profile of varying diameter and radial dimension relative to the centrally located longitudinal axis thereof along the length of the log members.

Figure 1:
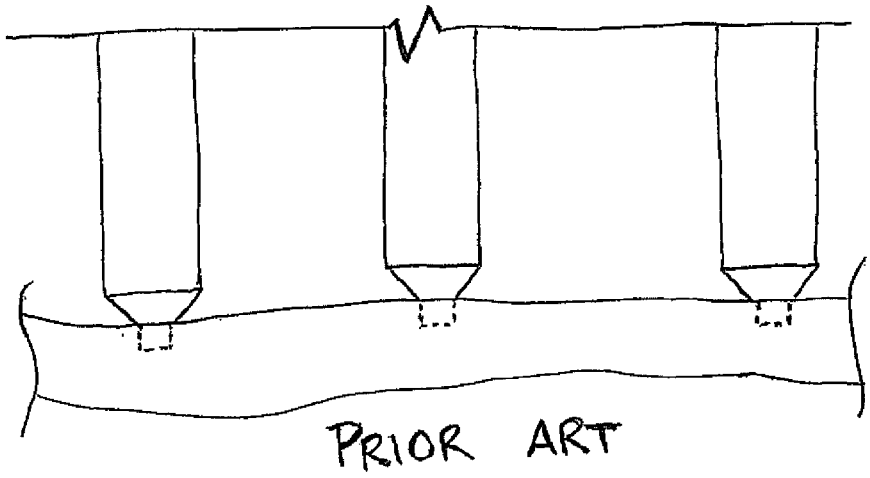
FIG. 1 is an elevational view of a prior art railing formed of log members joined by mortise and tenon connections.
Figure 2:
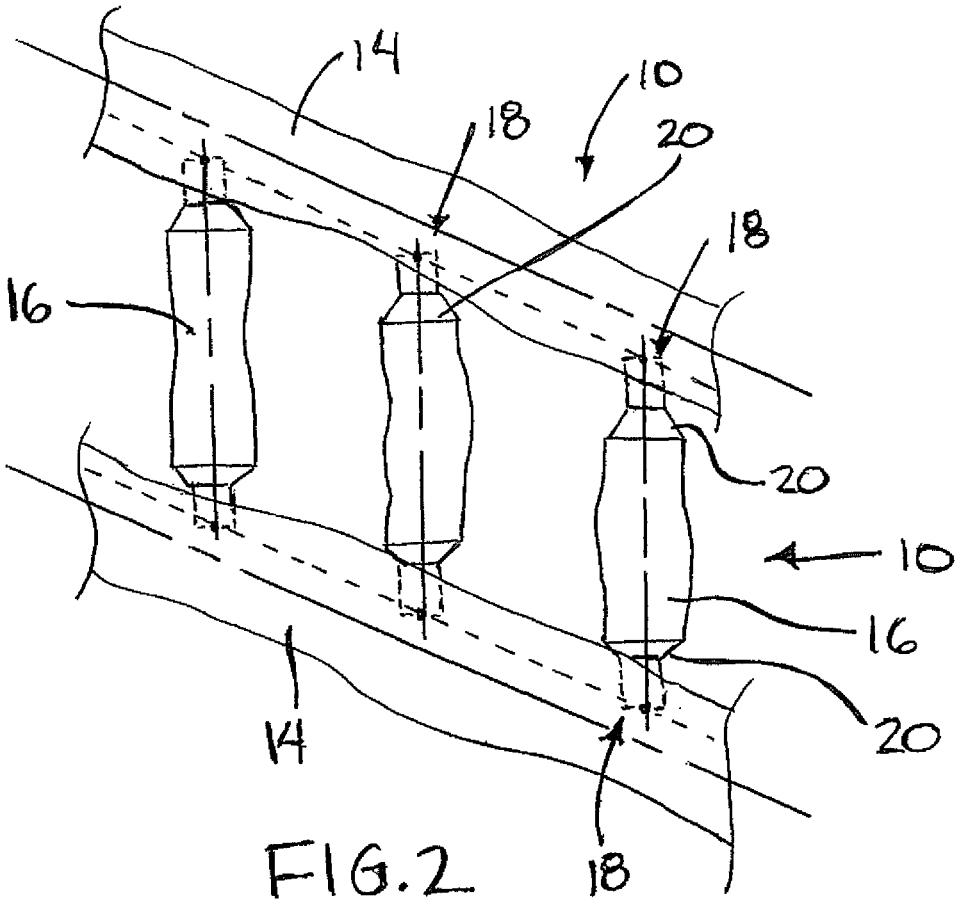
FIG. 2 is a side elevational view of a railing in which a depth of the mortises are controlled relative to the longitudinal axis of the logs in accordance with the present invention.
Figure 3:
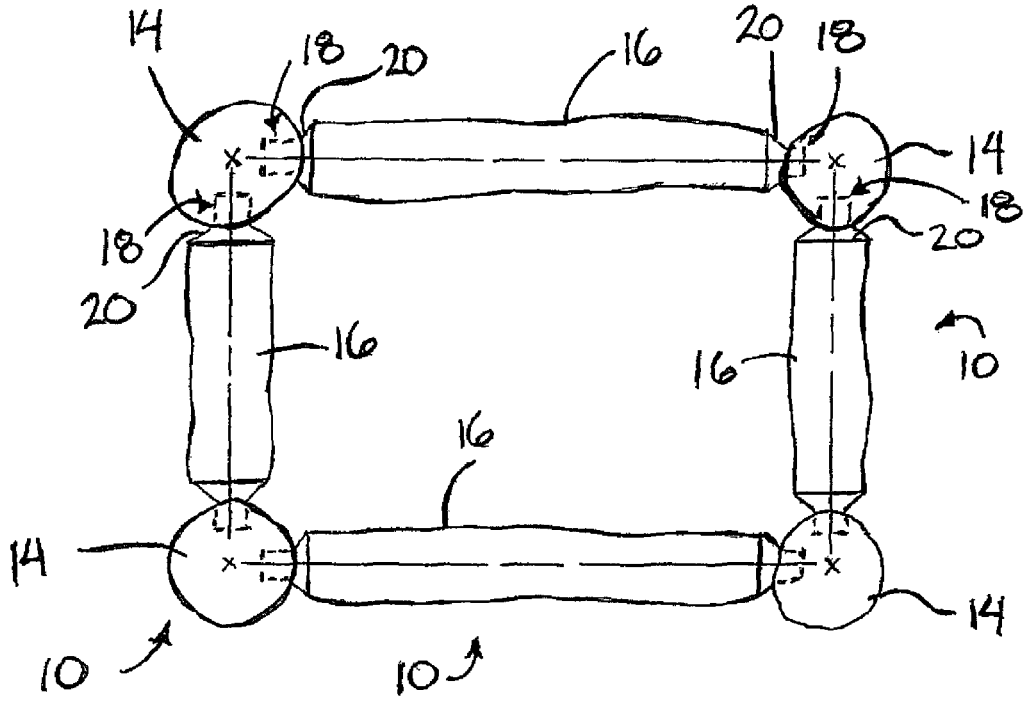
FIG. 3 is a top plan view of one embodiment of a frame assembled with logs using mortise and tenon joints.
Figure 4:
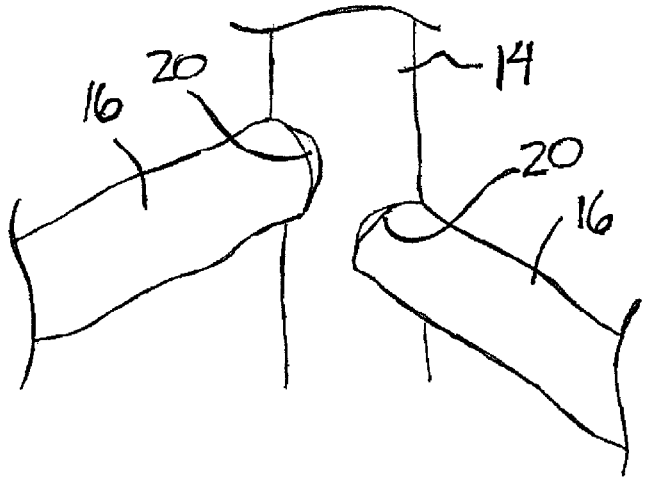
FIG. 4 is a perspective view of one corner of the frame according to FIG. 3.
Figure 5:
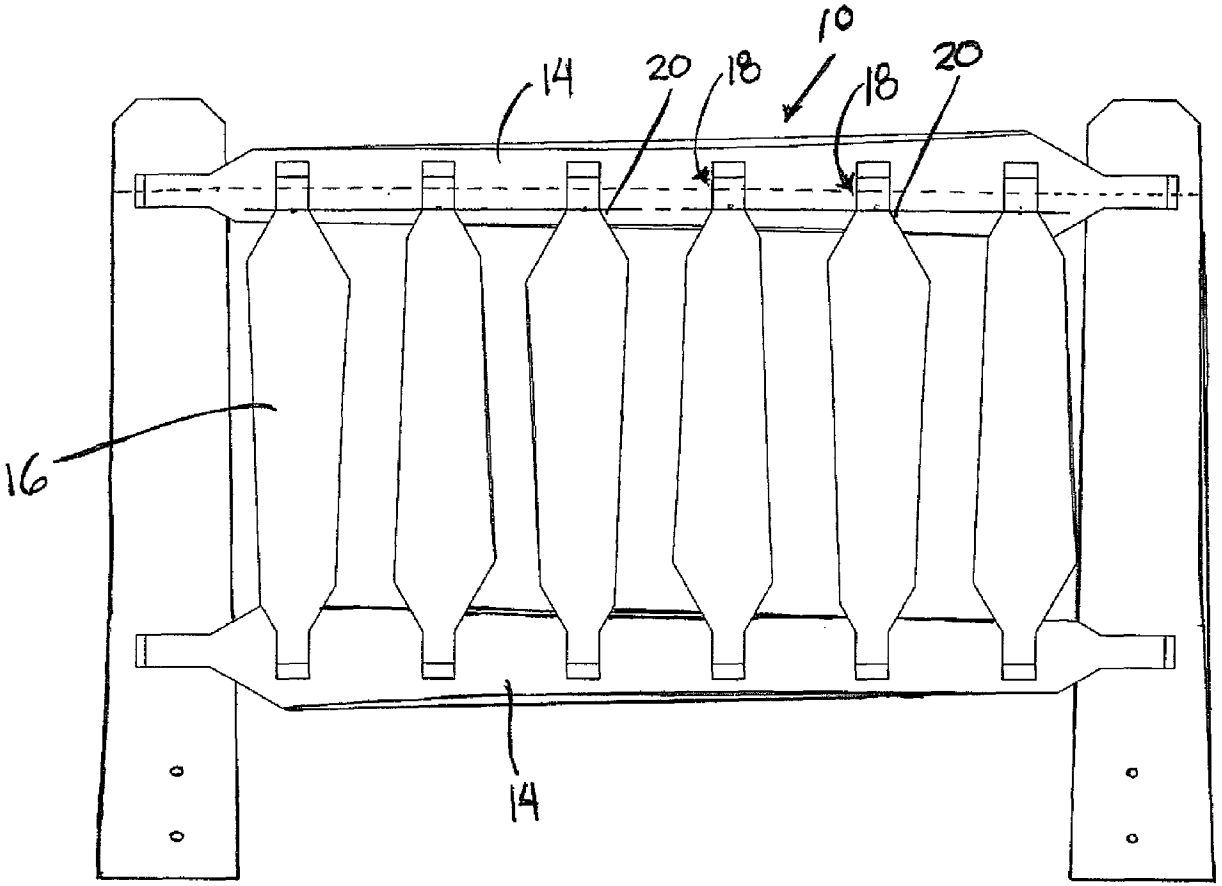
FIG. 5 is a side elevational view of a further embodiment of a railing in which a depth of the mortises are controlled relative to the longitudinal axis of the logs in accordance with the present invention.
Figure 6:
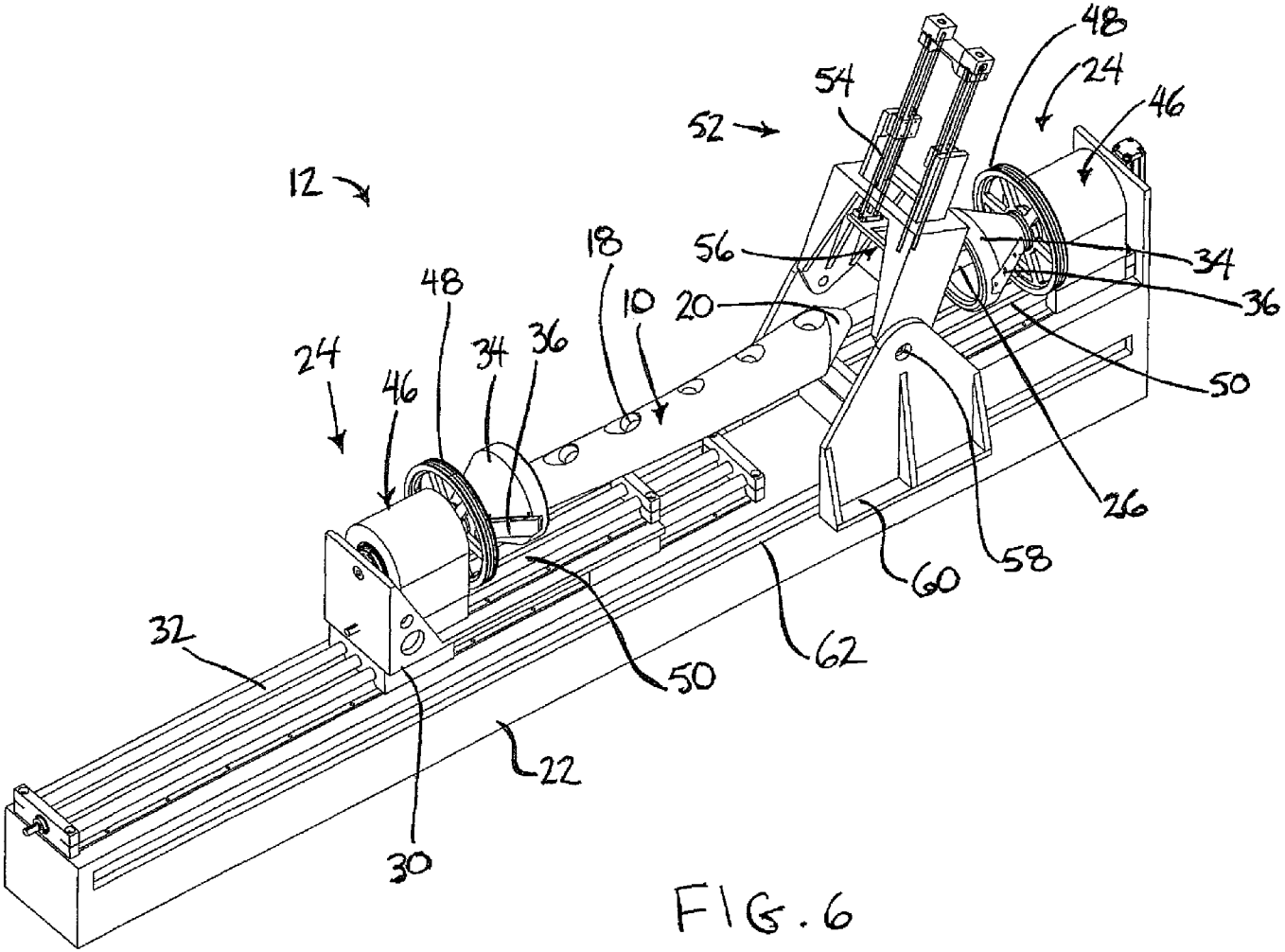
FIG. 6 is a perspective view of a mortise and tenon forming device.
Figure 7:
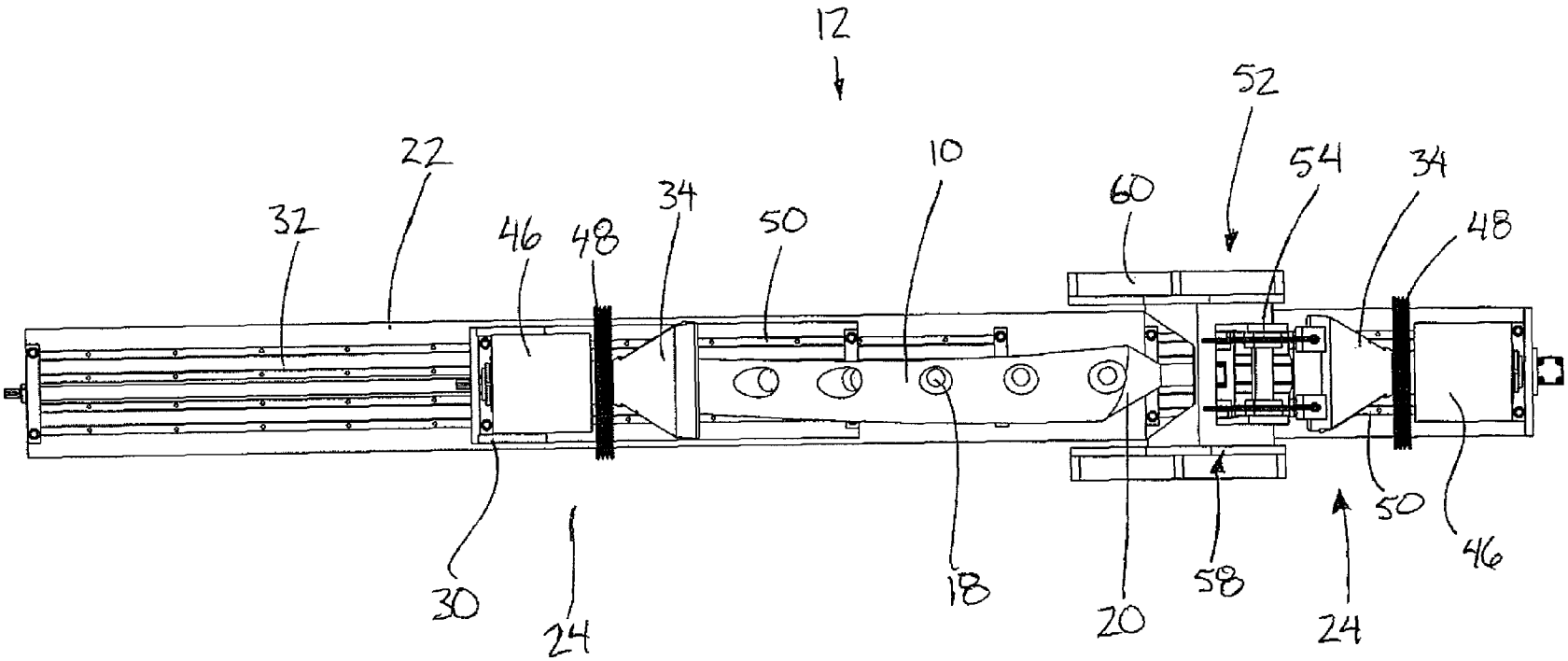
FIG. 7 is a top plan view of the device according to FIG. 6.
Figure 8:
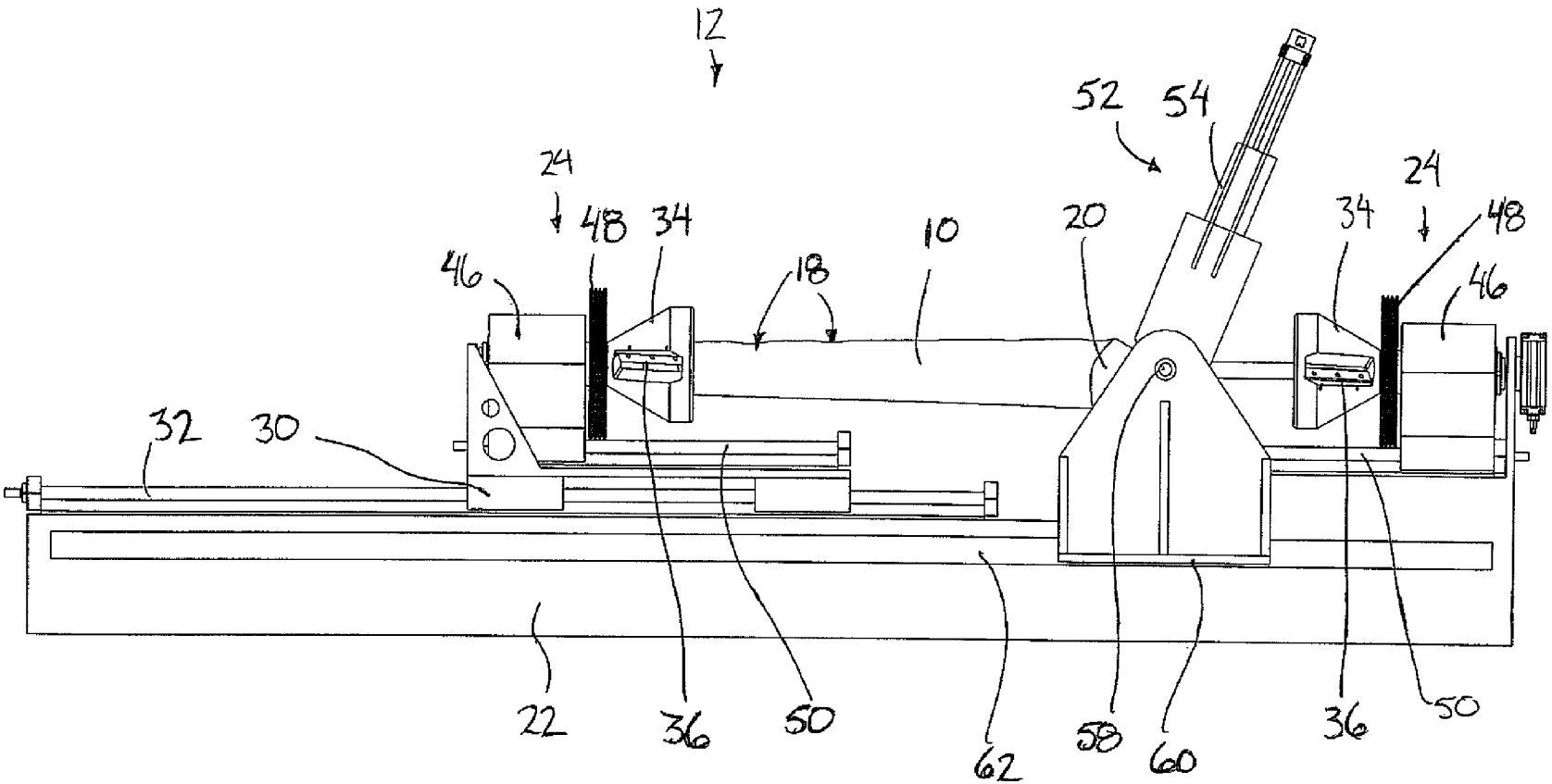
FIG. 8 is a side elevational view of the device according to FIG. 6.
Figure 9:
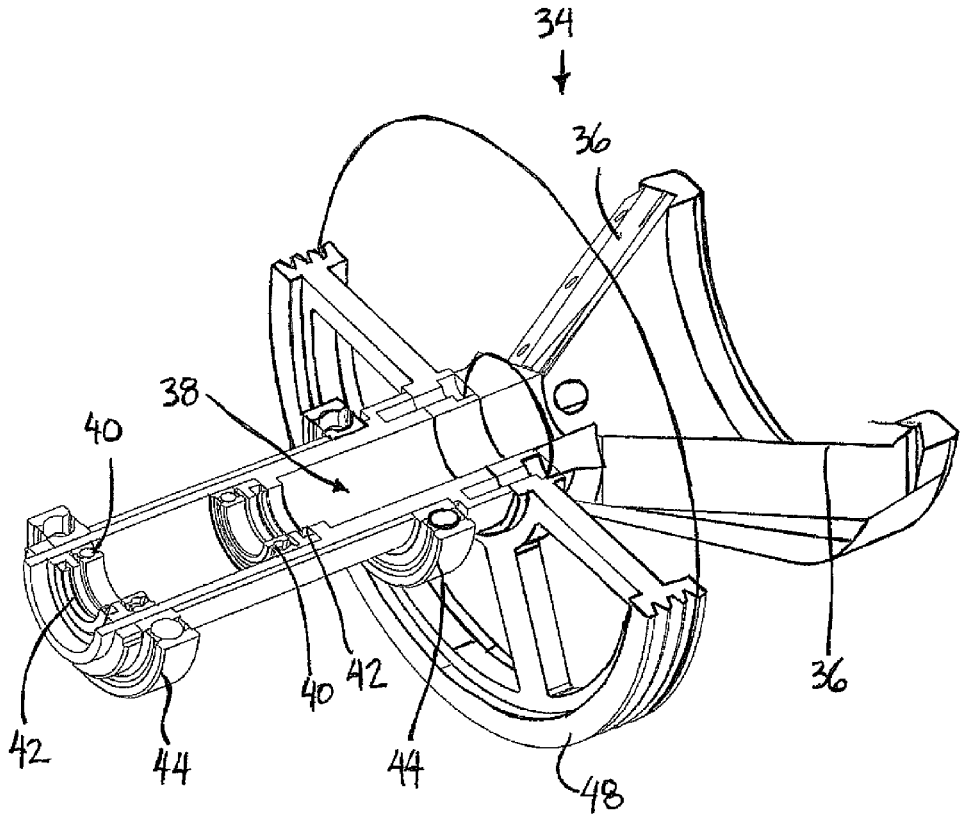
FIG. 9 is a partly sectional perspective view of one of the tenon cutters in the device of FIG. 6.
Figure 10:
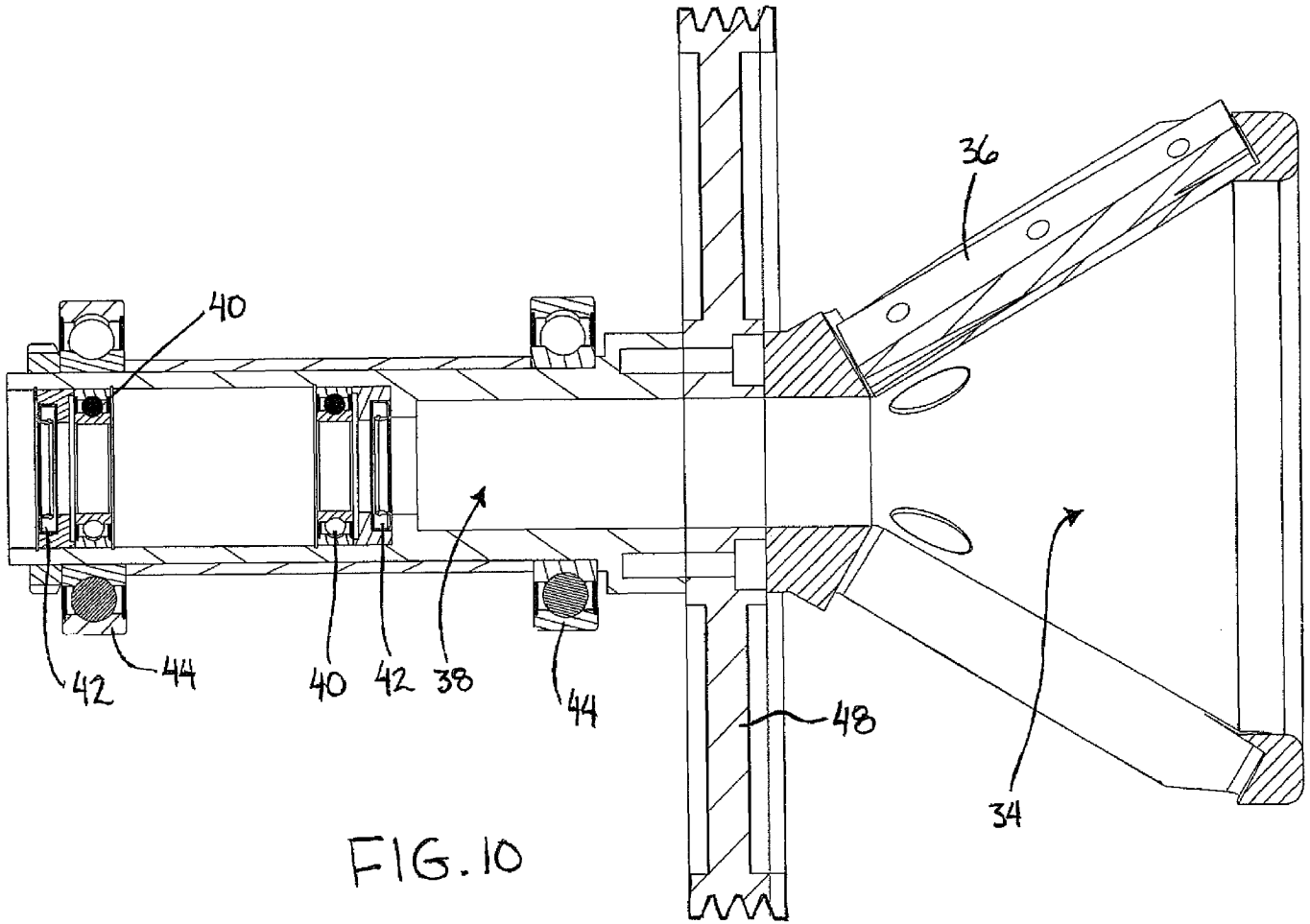
FIG. 10 is a sectional plan view of the tenon cutter according to FIG. 9.
Figure 11:
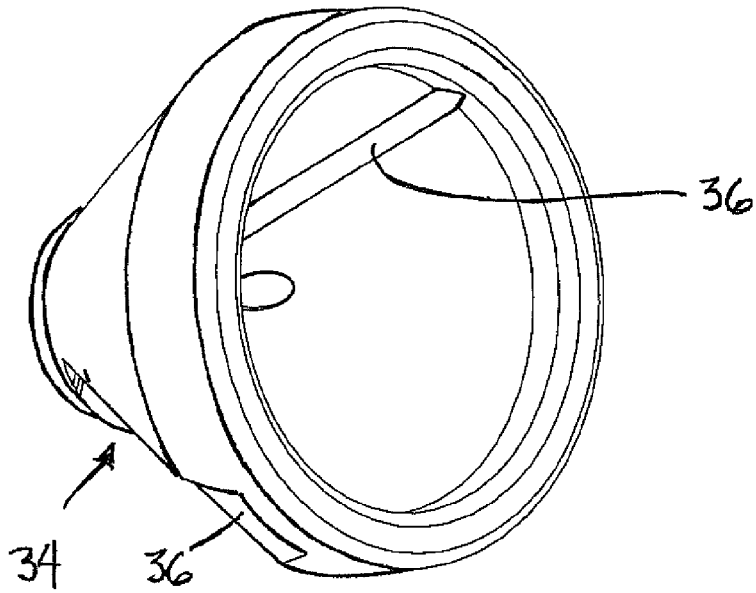
FIG. 11 is a perspective view of a portion of the tenon cutter in which a portion of the inner surface is visible.
Figure 12:
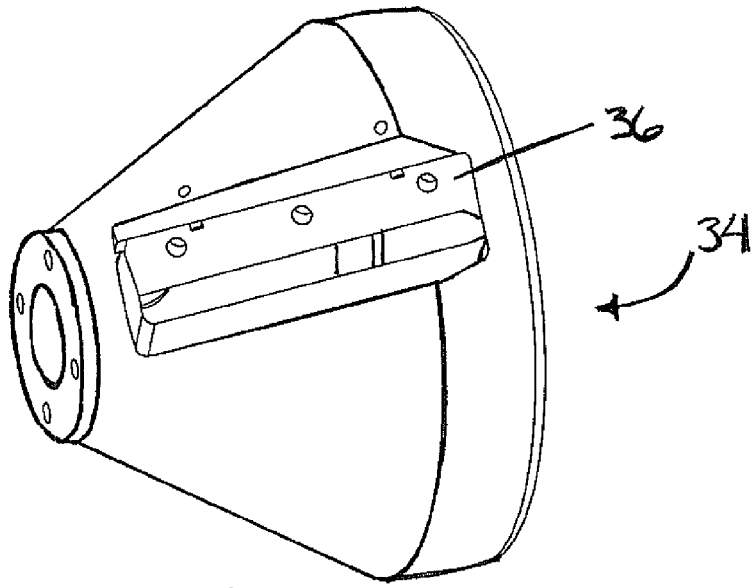
FIG. 12 is a perspective view of the portion of the tenon cutter according to FIG. 11 showing one of the blades relative to an outer surface of the cutter.

Turning initially to FIGS. 2 through 5, some examples of log member construction are illustrated and described in the following. In typical log member construction, for example a railing as shown in FIG. 2 or 5 or frames for furniture and the like as shown in FIG. 3 or 4, the construction begins by initially selecting a plurality of first log members 14 to comprise mortise bearing members and selecting a plurality of second log members 16 to comprise tenon bearing members for mating connection with the mortise bearing members. Each first log member 14 includes a plurality of mortise sockets formed therein having mating surfaces thereon for receiving respective tenons 20 matingly therein in which the tenons are formed at one or both ends of the second log members 16 and include respective mating surfaces which abut the mating surfaces of the mortise sockets when assembled. In some constructions, some log members will include both mortise sockets and tenons formed thereon.

In general, the construction using log members begins by initially locating a longitudinal axis extending centrally through each log member along the full length thereof between opposing ends of the log member. When constructing a railing or a frame as shown in the accompanying Figures, two first log members 14 are initially selected and arranged to be supported parallel and spaced apart from one another. A plurality of second log members 16 are then selected for connection between the first log members.

Initially the space between the longitudinal axes of the two first log members is measured and determined at the mounting location of each of the second log members to be coupled therebetween. This distance is constant for parallel first log members. A selected distance is then measured between the mating surface formed at the end of each second log member and the longitudinal axis of the first log member to which it is to be coupled.

The distance or length of the tenon member between mating surfaces at opposing ends thereof is thus determined as: (the distance between the longitudinal axes of the two first log members at the mounting location of the log member) plus or minus (the selected distance between each mating surface of the second log member and the respective longitudinal axis of the first log member to which it is coupled).

The mating surface of each tenon member may be determined to be the end face of the tenon member, for example, the mating surface may comprise the central end point of each second log member at the intersection of the longitudinal axis of the log member and a perpendicular end face at the end of the tenon 20 formed at the end of the second log member. Alternatively as described below with regard to FIG. 5, the mating surface may comprise a generally conical surface of the tenon member as described further below.

The selected distance between the mating surfaces of the log members and the longitudinal axis of the first log members to which they are coupled is typically selected to be constant among the plurality of second log members coupled to each first log member. Accordingly an axis as shown in broken line in FIG. 2 which connects the mating surfaces of the plurality of tenon bearing members when the mating surfaces comprises end points of the tenons lies parallel to the longitudinal axis of the respective first log member at the selected distance therebetween.

When forming the mortise sockets 18 for receiving the tenons therein which are defined by mating surfaces comprising the end faces of the tenons, the sockets are cut into the outer surface of the first log members to a depth such that an inner terminal end of the socket lying perpendicular to the axis of the socket lies at the selected distance from the longitudinal axis of the first log member for abutment with the end face of the tenon received therein and the inner terminal end defines the mating surface of the mortise socket in this instance.

With reference to the embodiment of FIG. 5, each tenon is formed to comprise a first portion of reduced diameter which is generally cylindrical at the outer free end of the log member and a second portion which is frustoconical in shape with increasing diameter from the cylindrical first portion to a remainder of the log member. The second portion defines a mating surface of the tenon having an end point lying at the longitudinal axis of the log where the axis intersects a circular plane at the intersection of the frustoconical and cylindrical portions of the tenon. The distance between the end points of the mating surfaces of the tenons at opposing ends of the log can be used in determining the effective length of the tenon bearing member when a gap is provided at opposing end faces of the tenons in the assembled configuration shown in FIG. 5.

Each mortise socket is also formed to comprise a first portion of reduced diameter which is generally cylindrical in shape at the inner terminal end of the socket and a second portion which is frustoconical in shape with increasing diameter from the cylindrical first portion to the outer surface of the log member within which the mortise socket is formed. The first portion of the socket matingly receives the first portion of the tenon therein and the second portion of the socket matingly receives the second portion of the tenon therein. The second portion of the socket defines the second mating surface of the tenon and mortise socket connection for abutment with the first mating surface when joined.

As shown in FIG. 5, arranging the first portion of the socket to be longer in the axial direction than the first portion of the tenon ensures a gap between the end face of the tenon and the inner terminal end of the socket even when the first and second mating surfaces are tightly engaged to ensure that the end faces to not interfere with the snug engagement of the mating surfaces. As described, arranging the conical surface of the tenon to mate with the corresponding conical surface of the mortise ensures a tight mating fit between the two members by calculating into the layout a gap between the end face of the tenon and the terminal end of the socket.

In the embodiment of FIG. 5, the critical control point is the intersection of the longitudinal axis of the tenon bearing member and the plane formed by intersecting the cylindrical portion and conical portion of the tenon. The position of the circular end face of the tenon, which is a parallel offset of the plane mentioned above and establishes the length of the cylindrical portion of the tenon is not critical to establishing a tight fit. As shown in FIG. 5, an axis can be joined between the end points of all of the mating surfaces which again lies parallel to the longitudinal axis of the mortise bearing member. Tenons at the end of the mortise bearing member shown are also coaxial with the longitudinal axis of the mortise bearing member.

In the instance of the conical portions defining the mating surfaces, the cone vertex (or centrepoint of the plane established by truncating the cone) is used as the primary mortise depth defining element ensuring that at least some portion of the cone is present in the mortise at the location of greatest surface spread between mortise bearing members. FIG. 5 illustrates the benefit of sinking the conical portion of the tenon into the mortise bearing member. The right most spindle location has the largest mortise bearing member surface to surface spread. The bottom joint at this location establishes the governing depth for all the mortises due to this being the minimum diameter rail material used on this particular example. The constant mortise depth, relative to the centerline, now having been established, which preferably leaves no portion of the cylindrical component of the tenon visible, allows for the conical portion of the tenons to "run out" of the mortises while remaining tight fitting as illustrated. All tenon bearing members in FIG. 5 are identical in length between the mating surfaces thereof so as to be modular.

Each of the second log members 16 is formed so that the tenons 20 at opposing ends thereof are coaxial with the longitudinal axis of the log member. When mounting second log members between parallel and spaced part first log members as in the example of FIG. 2, all of the tenon members are supported such that the longitudinal axes thereof are parallel and spaced part from one another with the log members being identical in length between the mating surfaces defined as end faces of the tenons formed at opposing ends thereof such that all of the second log members are readily interchangeable with one another. As shown in FIG. 5, the length of all tenon members between mating surfaces are also constant when defining the mating surfaces as conical portions of the tenons.

When two second log members 16 are coupled to a first log member so as to be perpendicular to one another or at angularly offset positions relative to one another about the longitudinal axis of the first log member as in the corner post of a frame as shown in FIGS. 3 and 4, the selected distance between the longitudinal axis of the first log member and the mating surfaces of the tenons 20 of each of the second log members coupled thereto is again measured and determined in a consistent manner so that parallel and opposed ones of the second log members are of identical length so as to be interchangeable with one another similarly to the previous example.

The multiple second log members coupled to each first log member may be mounted at differing selected distances from the longitudinal axis of the first log member in order to prevent any interference of the tenons when supported in the same plane. The length of each tenon bearing member between mating surfaces is determined in the same manner by determining: (the distance between the longitudinal axes of the two first log members between which the second log member is coupled) and subtracting (the selected distance between each mating surface of the second log member and the respective axis in the assembled frame structure) so that the second log member can be cut to the appropriate length. Even where log members have differing length, the length is standardized and readily reproduced so that multiple copies of a particular product being manufactured of irregular profile log members can be made with interchangeable parts with one another in a manner which is more consistent with mass production than prior art custom fabrication requirements for log members of irregular profile.

The device 12 which forms the tenons and mortise sockets comprises an elongate main frame 22 which supports two opposed work holders 24 thereon. The work holders are spaced apart on the frame so as to be arranged to engage opposing ends of a log member received therebetween such that a longitudinal axis of the log member extends along a central axis extending between the pair of work holders to define the axis of the log member.

The two work holders 24 are similar in configuration to one another such that each comprises a central spindle 26 in the form an elongate shaft which is coaxial with the central axis of the holders. An inner end of each spindle 26 includes a plurality of blades supported thereon to extend in a generally radial orientation outward beyond the end of the spindle in the axial direction so that a cutting edge is defined at the free edge of each of the blades which is arranged to be readily inserted into the ends of the log members. The blades serve to fix the central spindle 26 relative to the log member for rotation together about the central axis of the work holders.

One of the spindles 26 is arranged to be generally fixed in position relative to the frame in the longitudinal direction of the central axis whereas the other spindle is supported on a sliding frame 30 for longitudinal sliding movement on a track 32 which lies parallel to the central axis of the work holders. Movement of one of the central spindles and the associated components of the work holder with the sliding frame 30 relative to the main frame permits the space between the inner ends of the spindles to be adjusted for accommodating different lengths of log members to be mounted between the work holders. Once the blades 28 of the work holders are penetrated into opposing ends of the log member, the spindles can remain fixed in position relative to one another in the longitudinal direction to retain the log member clamped therebetween.

Each work holder further comprises a tenon cutter 34 in the form of an annular body supported about the respective central spindle for rotation relative to the spindle and the log member to which it is coupled. An inner surface of the annular body is frusto-conical in shape so as to be coaxial with the central axis extending between the pair of work holders and the central spindle 26.

The inner surface of the tenon cutter body includes a pair of diametrically opposed slots which support respective blades 36 therein. Each of the two diametrically opposed blades spans generally in the longitudinal direction of the central axis from an inner end of the frusto-conical body of smallest diameter to the outer end of greatest diameter which receives the end of the log therein. The blades are held within respective slots in the body for engaging the end of the log member to cut a frusta conical shaped formation at the end of the log member.

The body further comprises a central bore 38 which is formed at the inner end of the frusto conical shaped portion of the tenon cutter body in which the bore has the same diameter as the inner end of the conical portion and extends axially beyond the end of the frusto conical shaped portion. In this manner advancing the end of a log member into the tenon cutter causes the frustoconical shaped portion to form a similarly frustoconical shaped portion on the end of the log member while the bore 38 defines a cylindrical portion of the tenon 20 being formed which extends axially outward beyond the end of the frusta conical shaped portion of the tenon at the end of each log member.

The tenon cutter 38 rotatably supports the shaft of the central spindle 26 extending through the tenon cutter body at a pair of axially spaced apart positions beyond the inner end of the frustoconical shaped portion and the inner end of the central bore 36. The central spindle is supported relative to the cutter body and the bearing 40 thereof such that the spindle 26 remains slidable relative to the cutter 34 in the direction of the central axis.

Bushings 42 are provided at opposing outer sides of the pair of spaced apart bearings 40 to protect the bearings between the bushings from external debris throughout the longitudinal sliding of the spindle relative to the cutter by sliding engagement of the bushings 42 against the spindle.

In addition to internal bearings between the spindle and the cutter, external bearings 44 are provided about the cutter body so as to rotatably support the body of the tenon cutter 34 on a cutter housing 46. The body of the cutter 34 is supported by the bearings 44 for rotation relative to the cutter housing about a common axis coaxial with the spindle. A drive member 48 is supported about the body of the cutter 34 for rotation with the body about the axis of the external bearings 44. Typically the drive member 48 comprises a pulley having a peripheral surface which is coaxial with the spindle for engagement by a suitable drive belt and the like.

The cutter frame 46 is supported for longitudinal sliding movement relative to the main frame on respective cutter rails 50 which are parallel to the direction of the central axis of the work holders. The cutter rails 50, associated with the spindle that is fixed in longitudinal position relative to the main frame, are similarly fixed relative to the main frame. Alternatively, the cutter rails of the opposing work holder are slidable together with the moving spindle by supporting the cutter rails 50 on the sliding frame 30 for movement together therewith relative to the main frame. A suitable motor is provided to drive the belt in engagement with the drive member 48 in which the motor is moveable together with the cutter housing 46 relative to the spindle received therethrough.

In this arrangement each tenon cutter is slidable along the central axis relative to the central spindle received therethrough between a starting position in which the central spindle projects axially outward beyond the free end of the tenon cutter towards the opposing work holder for engagement with the end of a log member before the tenon is formed thereon and an ending position in which the tenon has been formed. In the ending position, the tenon cutter is slid axially beyond the end of the central spindle such that a portion of the log is received within the interior of the body of the tenon cutter for forming the frusto conical portion thereof while a further cylindrical portion of the tenon is also formed to extend beyond the frusto conical portion into the central bore of the tenon cutter 34. Once the tenon is formed by surrounding the end of the log member with the tenon cutter, the tenon cutter can be returned to the starting position for releasing the log member from the central spindle of the respective work holder.

In addition to the forming of tenons on the second log members 16, the device 12 is also capable of forming the mortise sockets in the same log members or different first log members 14. The device 12 includes a mortise cutting device 52 which includes a track frame 54 which rotatably supports a mortise cutter 56 thereon.

The mortise cutter 56 comprises a drill bit which is driven to rotate about a respective mortise cutter axis lying parallel to the longitudinal direction of the track frame 54. The bit of the cutter similarly comprises a first cylindrical portion and a second frustoconical portion which typically defines the mating surface of the mortise socket being formed at a controllable depth relative to the longitudinal axis of the mortise bearing member.

The mortise cutter 56 is supported on the track frame so as to be also linearly slidable in the longitudinal direction of the track frame parallel to the cutter axis. The track frame is generally oriented transversely to the central axis of the work holders such that the mortise cutter is supported for linear sliding in a generally radial direction relative to the central axis extending between the work holders for movement towards and away from the log member. Movement of the mortise cutter towards the log member permits the drill bit to be inserted into the outer surface of the log member for cutting a mortise socket into the log member. As noted above, the drill bit has a suitable shape for matingly receiving the cylindrical end portion and a portion of the frustoconical portion of the tenons in the resultingly formed mortise sockets.

The track frame 54 is supported by a pivot assembly 58 on the main frame in the form of two pivots located at diametrically opposed sides of the central axis for receiving the log member therebetween. The two pivots permit the track frame 54 to be pivotal about a common pivot axis oriented generally horizontally in a lateral direction which extends diametrically relative to the central axis in a plane perpendicular to the central axis. Typically the pivot axis is oriented to intersect the central axis so as to lie generally in a common plane therewith. Pivoting of the track frame 54 about the pivot axis of the pivot assembly 58 permits the angle of inclination of the linear sliding movement of the mortise cutter to be adjusted relative to the central axis and log supported therealong for controlling the angle of orientation of the mortise socket formed in the log member relative to the longitudinal axis thereof.

The pivot assembly includes a base 60 which is supported on respective longitudinally extending rails 62 on the main frame which lie parallel to the central axis of the main frame. In this manner the pivot assembly 58 together with the track frame supported thereon is slidable for locating the mortise cutter 56 thereon for sliding movement in the direction of the central axis along a full length of the main frame between the two work holders thereon. The location of a mortise socket formed by the cutter 56 can thus be controlled along a full length of any log members supported between the work holders. A suitable controller mechanism which controls the sliding movement of the mortise cutter along the track frame 54 controls the depth of cut of the mortise cutter into the outer surface of the log member relative to the longitudinal axis of the log defined by the central axis extending between the two work holders. By controlling the depth of the mortise cutter relative to the central axis of the work holders, mortise sockets can be cut into any irregular profile of log member with the terminal end of the socket being controllably located at the selected distance from the longitudinal axis of the log member to assemble a structure of log members with controllable tolerances and readily interchangeable parts as describe in relation to FIGS. 2 through 4 above.

A cylindrical type dimensioning system is proposed herein where control over each of the three degrees of freedom and a firmly established and reproducible origin would meet this requirement. The axial coordinate of the log, created by connecting the cross-sectional centroid at each end of the log and represented by the z-axis, would originate on the end-grain plane of the log, which corresponds to an x-y plane. The radial coordinate (r) would have its origin on the z-axis, with the angular coordinate being established by the degree of rotation of the log about its own axis. A machine, which uses this cylindrical dimensioning system, obtains an element of predictability and consistency not possible with the existing systems. All layout and machining can be accomplished independent of the surface conditions of the material.

The proposed general layout of the log shaping machine or device 12 described above, including some of the main component assemblies, which will accomplish the functional requirements laid out above, can be seen in the attached figures. When clamped between the two log support shafts, control over the three degrees of freedom is established.

The material is axially supported by the log support shafts, which constrain all three DOF's during the cutting stroke. These shafts will also act as bearing rods for the linear slide bearings contained within the tenon cutter assemblies. This allows for fixed support of the material while allowing the cutter head to both rotate about its own axis providing the necessary cutting motion, as well as allowing it to advance through the full range of the cutting stroke. The interface between the log and the log support shaft will provide the axial location reference for the cylindrical dimensioning system.

The mobile version of the tenon cutter assembly has the capacity to position itself to accommodate a range of material lengths. It is the forward positioning of this assembly that effectively clamps the log between the two log support shafts. As with the stationary tenon cutter assembly, once the log is clamped between the two shafts, the cutter head is free to advance axially and rotate about its own axis.

Mortises are cut with the mobile mortise cutter assembly. The assembly as a whole can be positioned axially relative to the fixed origin, and once in position the drill head plunge angle can be controlled. This allows the pitch of a staircase to be incorporated directly into the production process without having to move the material to a secondary operation. Once the mobile mortise cutter assembly has cut a series of mortises on any one plane, the log support shafts can rotate the log to any other angular position enabling mortises to be accurately drilled on multiple planes of the same log. This would be useful in the production of corner posts on decks or any number of furniture components.

Once the material is in place, dimensioning becomes a matter of intersecting lines rather than intersecting surfaces. Since the mortise depth relative to the datum axis is controllable and reproducible, the overall length of each spindle (or rail) can be made constant. The process has now become modular. In other words, where previous production methods would require individual components of custom length to be made for each location, this process can produce components of all the same length which will therefore fit anywhere in the whole system. Due to the common cross-section profile of the mortise and tenon, the interface between intersecting elements remains tight.

A series of established functional requirements met by the device 12 include: 1) Coaxial tenons, including the tapered transition which are accurately and consistently machined on both ends of the log by the establishment of the axial log support system provides a means of ensuring the coaxial placement of tenons on both ends of the log; 2) Tenon diameter is accurately and consistently reproduced by The design of the cutter head which has the capacity to adjust and set the cutting blade after each sharpening to ensure accurate diameter tenons; 3) Tenon depth is accurately controlled by the cylindrical dimension reference system which has an established origin at the interface between the spin centre and the end grain plane of the log, allowing for consistent and controllable tenon cutting depth; 4) Mortises with profiles matching the tenons are consistently and accurately machined into the lateral surface of the log by use of 60° shoulder bits and drill press assemblies; 5) Mortise depth relative to the log centerline is accurately controlled by the consistent placement of the centre axis of the log relative to the slide rails of the frame to allow for accurate mortise depth control; 6) Mortise placement along the axial direction of the log is accurately controlled by the origin of the cylindrical dimension reference system which allows for the accurate axial placement of the mortises; 7) the angle of the mortise relative to the log centerline is accurately controlled by any commercial drill press assembly which could be retrofitted to achieve control over the relative angle between the log centerline and the drill press plunge axis; 8) The angle of rotation of the log about its own axis is accurately controlled by controlling the orientation of the central spindles using a commercially available rotational actuator.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method of joining a plurality of elongate log members using mortise and tenon joinery in which the log members each comprise a natural log member which is elongate in a longitudinal direction of a respective longitudinal axis and which has an outer surface comprising a natural irregular profile of varying radial dimension relative to the longitudinal axis along a length of the log member, the method comprising:

selecting a first log member from said natural log members to comprise a mortise bearing member;

identifying the longitudinal axis of the first log member extending centrally through the first log member in the respective longitudinal direction along the length of the first log member;

selecting a second log member from said natural log members to comprise a tenon bearing member;

identifying the longitudinal axis of the second log member extending centrally through the second log member in the respective longitudinal direction along the length of the second log member;

forming a tenon at one end of the second log member comprising a first mating surface of reduced diameter relative to the natural irregular profile which is coaxial with the longitudinal axis of the second log member;

measuring a selected distance in an axial direction between the first mating surface of the tenon of the second log member and the longitudinal axis of the first log member;

forming a mortise socket in the first log member comprising a second mating surface in which the mortise socket is arranged to matingly receive the tenon therein such that the first and second mating surfaces are abutted with one another;

wherein the mortise socket is formed to have a depth relative to the outer surface comprising the natural irregular profile of the first log member such that the second mating surface is located at said selected distance from the longitudinal axis of the first log member when the first and second mating surface are abutted with one another.

2. The method according to claim 1 including forming the first and second mating surfaces to be generally conical in shape.

3. The method according to claim 2 including:

forming the tenon to comprise: a first portion of reduced diameter which is generally cylindrical; and a second portion which is generally conical which increases in diameter from the first portion to a remainder of the log member and which defines the first mating surface; and forming the mortise socket to comprise: a first portion of reduced diameter which is generally cylindrical to matingly receive the first portion of the tenon therein; and a second portion which is generally conical to matingly receive the second portion of the tenon therein and which defines the second mating surface.

4. The method according to claim 1 including:

selecting a plurality of second log members from said natural log members, each comprising a tenon bearing member having a tenon formed at one end thereof; and forming a mortise socket in the first log member to receive each of the second log members therein such that the mating surface of each mortise socket is located at said selected distance from the longitudinal axis of the first log member.

5. The method according to claim 4 including forming the mortise sockets such that an axis of each socket is oriented perpendicularly to the longitudinal axis of the first log member.

6. The method according to claim 4 including forming the mortise sockets such that an axis of each socket is oriented at an inclination to the longitudinal axis of the first log member.

7. The method according to claim 1 further comprising:

supporting a pair of first log members space apart from one another;

locating a plurality of mortise sockets in each of the first log members;

selecting a plurality of second log members;

forming tenons at opposing ends of each second log member such that a length of each second log member between opposing mating surfaces thereof is identical to the other second log members; and inserting the tenons into respective ones of the mortise sockets such that each second log member is supported to extend between the pair of first log members.

8. The method according to claim 7 including supporting the pair of first log members such that the longitudinal axes of the first log members are parallel and spaced apart from one another.

9. The method according to claim 7 including locating the plurality of mortise sockets in each of the first log members such that the mating surfaces of the mortise sockets within each first log member are located at a common selected distance from the longitudinal axis of the first log member.

10. The method according to claim 7 including providing a plurality of second log members and forming the tenons of the second log members such that the second log members are interchangeable with one another.

11. The method according to claim 1 including forming tenons on opposing ends of the second log member such that both tenons are coaxial with the longitudinal axis of the second log member.

12. A method of joining a plurality of elongate log members using mortise and tenon joinery, the method comprising:

selecting a first log member to comprise a mortise bearing member;

locating a longitudinal axis of the first log member extending centrally through the first log member in a longitudinal direction along a length of the first log member;

selecting a second log member to comprise a tenon bearing member;

locating a longitudinal axis of the second log member extending centrally through the second log member in a longitudinal direction along a length of the second log member;

forming a tenon at one end of the second log member comprising a first mating surface of reduced diameter which is coaxial with the longitudinal axis of the second log member;

measuring a selected distance in an axial direction between the first mating surface and the longitudinal axis of the first log member;

forming a mortise socket in the first log member comprising a second mating surface in which the mortise socket is arranged to matingly receive the tenon therein such that the first and second mating surfaces are abutted with one another;

wherein the mortise socket is formed to have a depth relative to an outer surface of the first log member such that the second mating surface is located at said selected distance from the longitudinal axis of the first log member when the first and second mating surface are abutted with one another;

wherein the mortise socket is formed using a mortise forming device comprising a pair of work holders supported on a frame at spaced apart positions by:

engaging opposing ends of the first log member with the pair of work holders such that the longitudinal axis of the first log member extends along a central axis extending between the pair of work holders;

providing a rotatable mortise cutter arranged to form a mortise socket in the first log member;

supporting the mortise cutter for movement in a radial direction relative to the central axis extending between the pair of work holders; and controlling a distance of the mortise cutter relative to the central axis so to located the mating surface of the mortise socket in the first log member at the selected distance relative to the central axis of the log member.

13. The method according to claim 12 including supporting the mortise cutter for rotation about a mortise cutter axis and supporting the mortise cutter on a track on the frame for linear movement relative to the work holders along the track which is oriented along the mortise cutter axis in the radial direction relative to the central axis extending between the pair of work holders.

14. The method according to claim 13 including supporting the track on the frame for pivotal movement relative to the frame about a lateral axis lying in a plane which is perpendicular to the central axis such that an orientation of the linear movement of the mortise cutter relative to the central axis is adjustable.

15. The method according to claim 12 wherein at least one of the work holders comprises:

a central spindle arranged to engage the respective end of the log member at the central axis of the work holders in fixed relation to the log member; and a tenon cutter surrounding the central spindle including at least one cutting blade for forming a tenon;

the central spindle and the tenon cutter being supported for rotation relative to one another about the central axis of the work holders so as to be arranged to rotate the tenon cutter relative to the log member; and the tenon cutter being slidable along the central axis relative to the central spindle between a starting position in which the central spindle projects axially towards the opposing work holder beyond the tenon cutter and an ending position in which the tenon cutter projects axially towards the opposing work holder beyond the central spindle so as to surround an end of the log member.

16. A method of joining a plurality of elongate log members using mortise and tenon joinery, the method comprising:

selecting a first log member to comprise a mortise bearing member;

locating a longitudinal axis of the first log member extending centrally through the first log member in a longitudinal direction along a length of the first log member;

selecting a second log member to comprise a tenon bearing member;

locating a longitudinal axis of the second log member extending centrally through the second log member in a longitudinal direction along a length of the second log member;

forming a tenon at one end of the second log member comprising a first mating surface of reduced diameter which is coaxial with the longitudinal axis of the second log member;

measuring a selected distance in an axial direction between the first mating surface and the longitudinal axis of the first log member;

forming a mortise socket in the first log member comprising a second mating surface in which the mortise socket is arranged to matingly receive the tenon therein such that the first and second mating surfaces are abutted with one another;

wherein the mortise socket is formed to have a depth relative to an outer surface of the first log member such that the second mating surface is located at said selected distance from the longitudinal axis of the first log member when the first and second mating surface are abutted with one another;

wherein the mortise socket is formed using a tenon forming device comprising a pair of work holders supported on a frame at spaced apart positions by:

engaging opposing ends of the second log member with the pair of work holders such that the longitudinal axis of the second log member extends along a central axis extending between the pair of work holders;

arranging one of the work holders to comprise a central spindle engaging the respective end of the second log member at the central axis of the work holders in fixed relation to the log member and a tenon cutter surrounding the central spindle including at least one cutting blade for forming the tenon;

rotating the central spindle and the tenon cutter relative to one another about the central axis of the work holders so as to rotate the log member relative to the tenon cutter; and displacing the tenon cutter slidable along the central axis relative to the central spindle from a starting position in which the central spindle projects axially towards the opposing work holder beyond the tenon cutter and an ending position in which the tenon cutter projects axially towards the opposing work holder beyond the central spindle so as to surround an end of the log member and form the tenon therein.

17. The method according to claim 16 including supporting the central spindle and the tenon cutter for rotation relative to one another independently of the relative sliding movement between the starting position and the ending position.

18. The method according to claim 16 wherein both of the work holders comprise a central spindle and a tenon cutter which are substantially identical to one another and wherein the method includes supporting one of the central spindles to be fixed in a direction of the central axis relative to the frame and supporting the other one of the central spindles to be adjustable in the direction of the central axis relative to the frame so as to be arranged to adjust a relative spacing between the work holders.

* * * * *